US006971147B2

(12) United States Patent
Halstead

(10) Patent No.: US 6,971,147 B2
(45) Date of Patent: Dec. 6, 2005

(54) CLIP

(76) Inventor: Paul Anthony Halstead, 607/37 McLaren Street, North Sydney, New South Wales, 2060 (AU)

( * ) Notice: Subject to any disclaimer, the term of this patent is extended or adjusted under 35 U.S.C. 154(b) by 0 days.

(21) Appl. No.: 10/656,506

(22) Filed: Sep. 4, 2003

(65) Prior Publication Data

US 2005/0097711 A1 May 12, 2005

(30) Foreign Application Priority Data

Sep. 5, 2002 (AU) ..... 2002951242

(51) Int. Cl.[7] ..... A44B 21/00
(52) U.S. Cl. ..... 24/303
(58) Field of Search ..... 355/285, 303, 355/304; 24/303, 66.1; 248/206.5

(56) References Cited

U.S. PATENT DOCUMENTS 3,468,576 A * 9/1969 Beyer et al. ..... 292/251.5
4,222,489 A * 9/1980 Hutter ..... 211/45
5,794,767 A 8/1998 Wilson
6,282,760 B1 * 9/2001 Mars ..... 24/303

FOREIGN PATENT DOCUMENTS

EP 29500 A * 6/1981 ..... A47B 97/02

* cited by examiner

*Primary Examiner*—James R. Brittain
(74) *Attorney, Agent, or Firm*—Dorsey & Whitney LLP

(57) ABSTRACT

A clip (10) for holding banknotes has a first clasp portion (14) and a second clasp portion (12) for holding banknotes therebetween. The first clasp portion (14) has a first magnetic portion (22) including magnetic material (30,32) and the second clasp portion has a second magnetic portion including magnetic material (18,19). The first magnetic portion (22) is moveable relative to the second magnetic portion between: a closed position whereby the interaction of the magnetic material of the first magnetic portion (30,32) and second magnetic portion (18,19) is such that there is a net force of attraction to hold the first and second clasp portions (14,12) together; and an open position whereby the first and second clasp portions (14,12) are released apart.

11 Claims, 2 Drawing Sheets

CLIP

FIELD OF THE INVENTION

The present invention relates to a clip. In particular although not exclusively, the invention relates to a money clip for holding banknotes. While the invention has been described particularly in regard to banknotes, the clip may be used in relation to other security documents, such as passports, bonds, letters of credit etc.

BACKGROUND TO THE INVENTION

A conventional money clip typically comprises a piece of metal bent over double to form two arms which are resiliently sprung together between which banknotes may be positioned. The two arms are not easy to manipulate in order to insert or withdraw the banknotes from between the arms of the money clip.

U.S. Pat. No. 5,794,767 illustrates a money clip comprised of two rubber sheets which are foldable to overlap each other. Each sheet has rubberised magnetic material which attract to hold banknotes therebetween. The inherent disadvantage of this arrangement is that it is not effective as a money clip. If the magnets are weak, then the two sheets will be easily separable in order to access the money. However weak magnetics will result in the money clip being unable to tightly hold the money. With a large bundle of notes the prior art money clip may be completely ineffective. On the other hand, if the magnetics are strong then the money clip may be effective to hold the money therebetween. However, it may difficult in such an arrangement to prise the two sheets apart in order to access the money.

It is therefore an object of the present invention to provide a money clip which overcomes or at least addresses the foregoing disadvantages or at least provides the public with a useful choice.

SUMMARY OF INVENTION

In accordance with a first aspect of the present invention, there is provided a clip for holding banknotes having: two clasp portions moveable relative to one another for holding banknotes therebetween; a moveable portion, moveable relative to one of the two clasp portions; and magnetic material operably associated with the moveable portion, the moveable portion being moveable between a first closed position whereby the operation of the magnetic material is such as to hold the first and second clasp portions together and an open position whereby the first and second clasp portions are released apart.

Preferably, magnetic material is disposed on the moveable portion. Furthermore the moveable portion may be mounted on the first clasp portion and the second clasp portion may also comprise magnetic material. Alternatively, the magnetic material within the moveable portion may cooperate with a ferrous part or another part of temporarily magnetisable material forming part of the second clasp portion.

In a more preferred aspect of the invention, there is provided a clip for holding banknotes having a first clasp portion and a second clasp portion for holding banknotes therebetween, the first clasp portion having a first magnetic portion including magnetic material and the second clasp portion having a second magnetic portion including magnetic material, wherein the first magnetic portion is moveable relative to the second magnetic portion between: a closed position whereby the interaction of the magnetic material of the first and second magnetic portions is such that there is a net force of attraction to hold the first and second clasp portions together; and an open position whereby the first and second clasp portions are released apart.

The first and second clasp portions may comprise two separate pieces. These pieces may be substantially plate-like or planar. Preferably the first and second clasp portions are rectangular portions of preferably the same size so as to substantially overlap in the closed configuration. However, the first and second clasp portions are not limited to being rectangular. Any shape is possible including round, square, depending upon the aesthetic effect required.

Preferably, the two pieces forming the first and second clasp portions are hingeably connected so as to be pivotable relative to one another between open and closed configurations. In a particularly preferred embodiment, a flexible hinge may be provided to accommodate a varying thickness of banknotes. This may be achieved by way of a floating hinge as per the preferred embodiment described below.

However, the money clip of the present invention is not limited to having the two clasp portions pivotable relative to one another. The first and second clasp portions may instead be slideable relative to one another and moveable between an off-set configuration whereby the banknotes may be inserted and an overlapped configuration whereby the banknotes may be held therebetween.

While the first and second clasp portions may be two separate pieces, they may also be integral. For example, the first and second clasp portions may be plastic with a living hinge provided therebetween.

The first magnetic portion may be arranged to slide relative to the first clasp portion. Where the first clasp portion is plate-like or planar, the first magnetic portion may be disposed to slide along the general plane of the first clasp portion. The first magnetic portion may be in the form of a slide disposed on the inner side of the first clasp portion which is preferably operable from the exterior of the clip. In a most preferred form of the invention, a slot is provided in the first clasp portion with a moveable actuator being disposed on the outer side of the first clasp portion to operate the first magnetic portion within the clip.

Any type of magnetic material may be incorporated into the clip. In a most preferred form of the invention, the magnetic material comprises rare earth magnets. Rare earth magnets are magnets that are made out of the rare earth group of elements in the atomic table. The most common rare earth magnets are Neodymium-Iron-Boron and Samarium Cobalt types. Rare earth magnets are currently the most powerful magnets available.

The first magnetic portion and the second magnetic portion may each comprise a single magnet arranged such that in the closed position of the first magnetic portion, the adjacent portions of the magnetic material in the first and second magnetic portions will have opposite poles to thereby attract. In a most preferred form of the invention the arrangement of magnetic material is such that in the open position of the first magnetic portion, there is a net force of repulsion between the first magnetic portion and the second magnetic portion tending to repel the first and second clasp portions apart. To achieve such an arrangement, it is preferred that the first magnetic portion comprises at least one band of magnetic material extending across the width of the first magnetic portion with the polarity reversing through the thickness of the band. Further, in this embodiment, the second magnetic portion may have a plurality of bands of magnetic material extending across the width of the second magnetic portion with the polarity reversing through the thickness of the bands. The bands on the second portion are preferably arranged such that with the first magnetic portion in the closed position, the band of the first magnetic portion will be attracted to one of the bands of the second magnetic portion thereby holding the first and second portions together. Furthermore, in the open position, the band of the first magnetic portion is disposed adjacent to the other band of the second magnetic portion whereby the polarity is such that these two bands repel each other to repel the two clasp portions apart.

In a most preferred form of the invention, the first magnetic portion has a series of bands of alternating polarity through the thickness of the bands and the second magnetic portion has a series of bands with alternating polarity through the thickness of the bands such that in the closed position of the first magnetic portion, the adjacent bands attract and in the open position, the adjacent bands repel each other. Preferably, the bands are spaced from each other.

The clip may also be provided with a lock or catch to prevent unauthorised release of the first and second portions.

This invention may also be said broadly to consist in the parts, elements, and features referred to or indicated in the specification of the application, individually or collectively, and any or all combinations of any two or more of said parts, elements or features, and where specific integers are mentioned herein which have known equivalents in the art to which this invention relates, such known equivalents are deemed to be incorporated herein as if individually set forth.

BRIEF DESCRIPTION OF THE DRAWINGS

In order that the invention may be more fully understood, one embodiment will now be described by way of example by reference to the drawings in which.

DESCRIPTION OF PREFERRED EMBODIMENT

Figure 1:
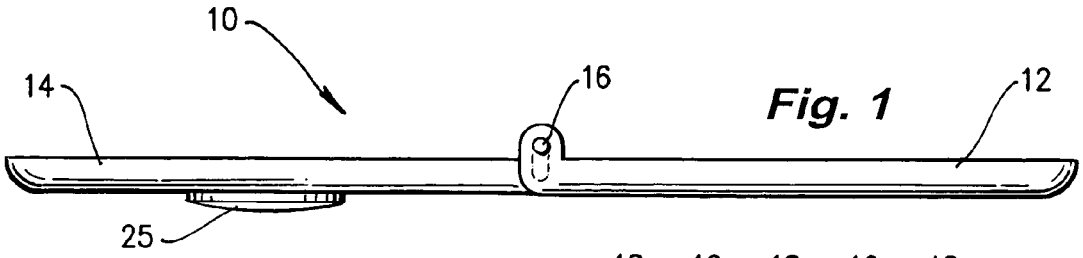
FIG. 1. is a side view of a clip according to a first preferred embodiment of the present invention.
Figure 2:
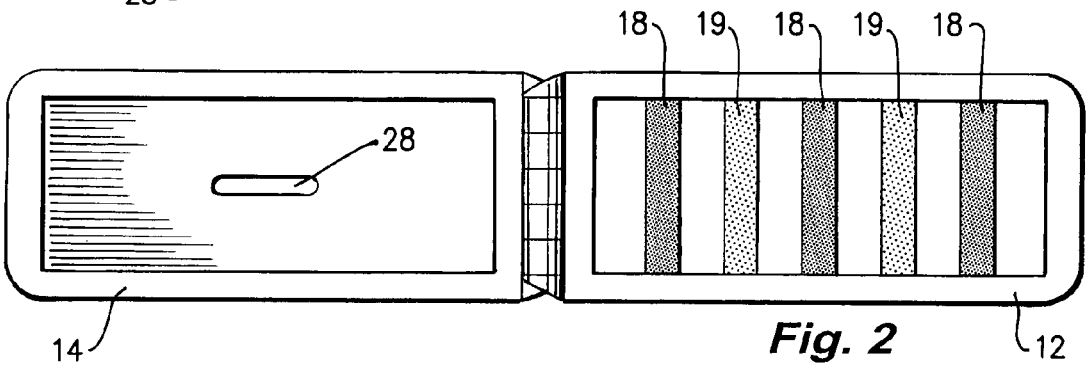
FIG. 2. is a plan view of the clip of FIG. 1 with a part omitted.
Figure 3:
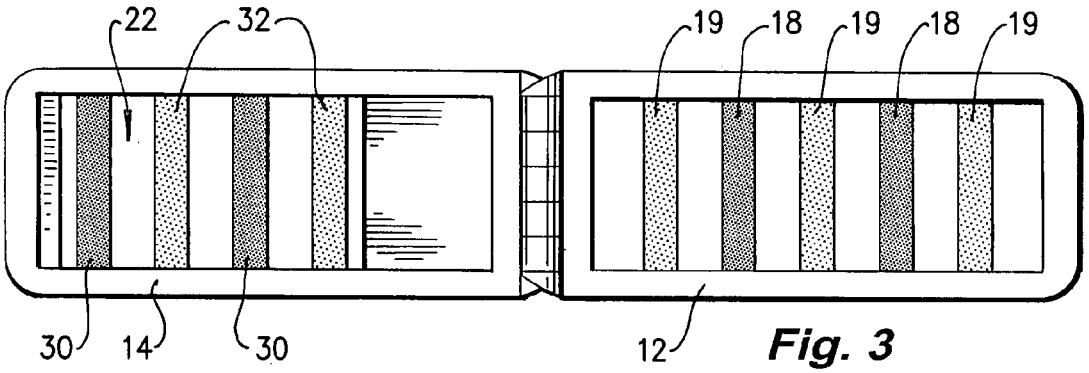
FIG. 3. is a plan view of the clip of FIG. 1 including a moveable first magnetic portion.
Figure 6:
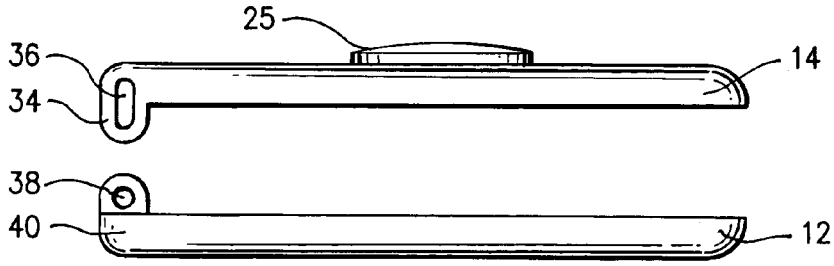
FIG. 6. is a side view of the clip of FIG. 3 in the closed configuration, also separately illustrating the form of the top clasp portion.

The clip 10 illustrated in FIG. 1 comprises a first clasp portion 14 and a second clasp portion 12 which are pivotably connected through pivot 16. The arrangement of the two clasp portions 12, 14 is such that the clasp portions 12, 14 are able to be separated to form an angle of 180 degrees and to form the closed configuration illustrated in FIG. 6. Each of the clasp portions 12, 14 is constructed from metal and is substantially planar and rectangular in plan as illustrated in FIG. 2. Further, as illustrated in FIG. 2, the second clasp portion 12 is provided with a series of spaced bands of magnetic material 18, 19. The bands 18, 19 extend across the width of the second clasp portion 12. FIG. 2 illustrates the polarity of bands 18, 19 by shading. Bands 18 have an upper surface which is positive as depicted by dark shading and a lower surface (not shown) which is negative. On the other hand, the light shading of the bands 19 illustrates negative polarity on the top surface with positive polarity on the under surface (not shown). FIG. 3 is similar to FIG. 2 except that the polarity of the bands has been reversed. This polarity is adopted in the remainder of the Figures. The bands of magnetic material in the second clasp portion 12 form the second magnetic portion.

Figure 4:
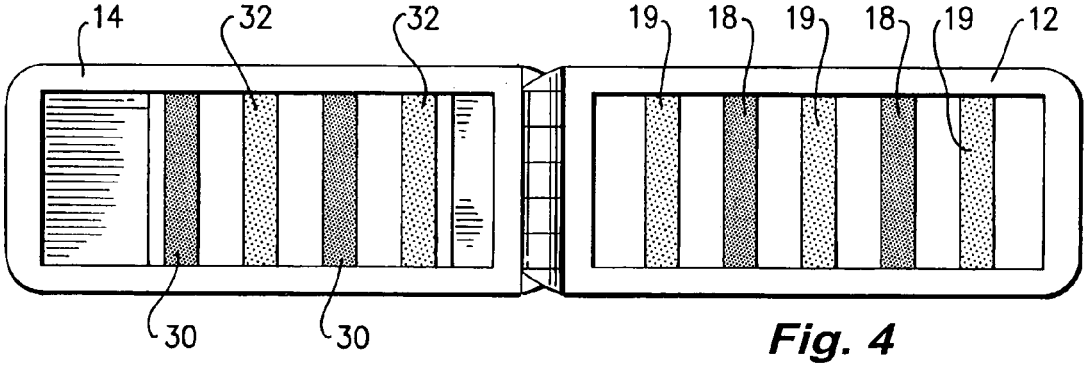
FIG. 4. is a plan view as in FIG. 3 except with the moveable first magnetic portion shown in a different position.
Figure 5:
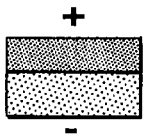
FIG. 5. is a diagram illustrating the polarity of the magnets used in the clip of FIG. 3.
Figure 7:
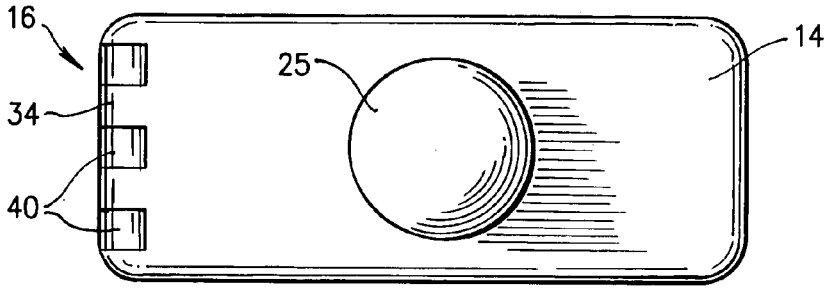
FIG. 7. is a plan view of the clip of FIG. 6 in the closed configuration.
Figure 8:
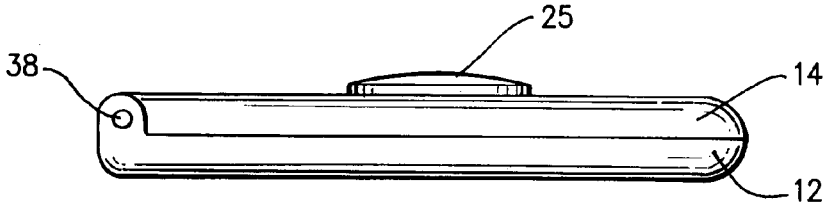
FIG. 8. is a side view as in FIG. 6 except with the actuator shown in the closed position.

FIG. 3 illustrates the form of the first magnetic portion 22 which is in the form of a slide. The slide 22 is disposed in a rectangular recess provided on the inner face of the first clasp portion 14. The slide 22 is moveable back and forth between the position illustrated in FIG. 3 and the position illustrated in FIG. 4. To achieve this movement of the slide 22 from the exterior of the clip 10, the slide 22 is connected to a manually operable actuator 25. As can be seen in FIG. 7, the manually operable actuator 25 is circular in plan. A stem (not shown) interconnects the actuator 25 with the slide 22 through a slot 28 in the first clasp portion 14 which can be seen in FIG. 2.

The slide 22 also has a series of spaced bands of magnetic material which extend across the width of the slide 22. Like the second magnetic portion, the bands of the first magnetic portion also have their polarity arranged through the thickness of the bands with an alternating arrangement from one band to the next. The bands 30 have a positive polarity on their inner surface and a negative polarity on their outer surface. As also illustrated by the shading of the bands, bands 32 have a negative polarity on their inner surface as shown and a positive polarity on the outermost surface. In this context, "inner" and "outer" are understood as being relative to the clip. The inner surfaces will come into contact with banknotes to be contained within the clip whereas the outer surfaces face away from the banknotes.

Figure 11:
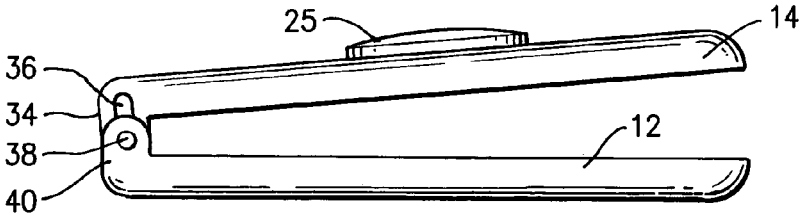
FIG. 11. is a side view illustrating the open configuration of the clip.

Given the banknotes held within the clip 10 may form a bundle of variable thickness, the clip 10 is arranged with a floating hinge. As can be seen from FIG. 6, the first clasp portion 14 is provided with hinge portions 34 which are slotted as shown. Each slot 36 is arranged with its length direction running perpendicular to the general plane of the first clasp portion 14. The pivot 16 includes a pin 38 journalled in a circular aperture within a hinge portion 40 of the second clasp portion 12. The provision of the slots 36 enables the first clasp portion 14 to overlay the second clasp portion 12 in a parallel arrangement at a variety of spacings determined by the length of the slots 36. The operation of the pivot 16 is illustrated further in FIGS. 11 and 12.

Figure 9:
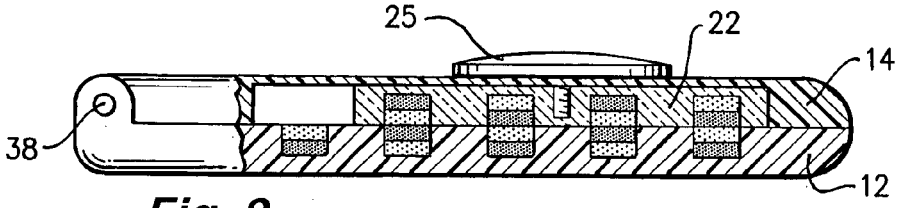
FIG. 9. is a cross-sectional view illustrating the alignment of the magnets.
Figure 10:
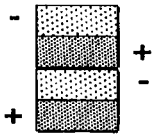
FIG. 10. is a diagram illustrating the polarity of adjacent magnets.
Figure 12:
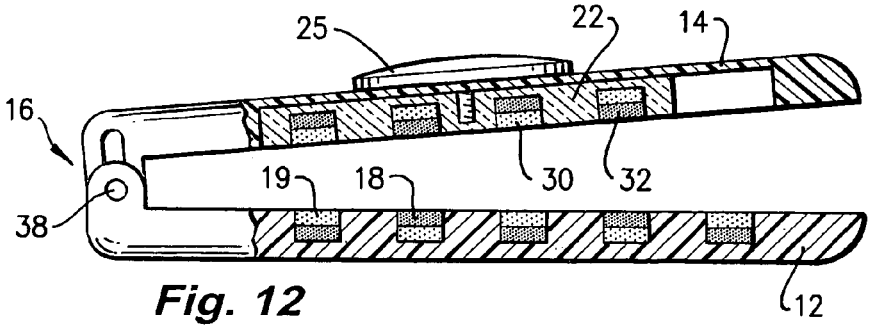
FIG. 12. is a cross-sectional view illustrating the alignment of the magnets in the open configuration.

As already explained, the slide 22 is moveable between a closed position illustrated in FIG. 9 and an open position illustrated in FIG. 12. In the closed position, it can be seen that each inner surface of the magnetic bands 30, 32 will be opposite in polarity to the inner surface of the vertically aligned bands 18, 19 of the second magnetic portion. This arrangement is illustrated diagrammatically in FIG. 10. Therefore, in the closed position of the slide 22, the magnetic bands will attract and the first and second clasp portions 14, 12 will be held together firmly, depending upon the strength of the magnets.

Figure 13:
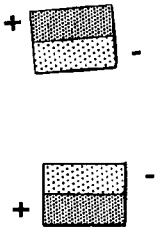
FIG. 13. is a diagram illustrating the polarity of an aligned pair of magnets.

In FIG. 12, the slide 22 has been moved to the open position. In this open position, the inner surfaces of the bands 30, 32 of the slide 22 will have the same polarity as the inner surfaces of the vertically aligned bands 18, 19 of the second magnetic portion. This arrangement of polarity is illustrated diagrammatically in FIG. 13. With the same polarity on the inner surfaces, the bands of magnetic material will repel one another leading to the first and second clasp portions 14, 12 being repelled to the open configuration illustrated in FIG. 12 thereby permitting the banknotes to be withdrawn from the clip.

The foregoing describes only one embodiment of the present and modifications may be made thereto within the spirit of the invention without departing from the scope of the invention.

What is claimed is:

1. A money clip for holding banknotes having a first clasp portion and a second clasp portion for holding banknotes therebetween, the first clasp portion having a first magnetic portion including magnetic material and the second clasp portion having a second magnetic portion including magnetic material, wherein the first magnetic portion is moveable relative to the first clasp portion and the second magnetic portion between: a closed position whereby the interaction of the magnetic material of the first and second magnetic portions is such that there is a net force of attraction to hold the first and second clasp portions together; and an open position whereby the first and second clasp portions are released apart, the first clasp portion being further provided with an actuator portion for movement of the first magnetic portion, wherein the first and second clasp portions are hingeably connected so as to be pivotable relative to one another between open and closed configurations, and wherein a floating hinge is provided between the first and second clasp portions, the floating hinge including a hinge pin journalled in apertures of the first and second clasp portions, one of said apertures being in the form of a slot.

2. A money clip for holding banknotes having a first clasp portion and a second clasp portion for holding banknotes therebetween, the first clasp portion having a first magnetic portion including magnetic material and the second clasp portion having a second magnetic portion including magnetic material, wherein the first magnetic portion is moveable relative to the first clasp portion and the second magnetic portion between: a closed position whereby the interaction of the magnetic material of the first and second magnetic portions is such that there is a net force of attraction to hold the first and second clasp portions together; and an open position whereby the first and second clasp portions are released apart, the first clasp portion being further provided with an actuator portion for movement of the first magnetic portion, wherein the first magnetic portion is arranged to slide relative to the first clasp portion.

3. The money clip as claimed in claim 2 wherein the first magnetic portion is in the form of a slide disposed on the inner side of the first clasp portion.

4. The money clip as claimed in claim 3 wherein the first clasp portion is provided with a slot, with the actuator portion being disposed on the outer side of the first clasp portion to operate the first magnetic portion within the clip.

5. The money clip as claimed in claim 2 wherein the first magnetic portion has at least one band of magnetic material extending across the width of the first magnetic portion with the polarity reversing through the thickness of the band and the second magnetic portion has at least one band of magnetic material extending across the width of the second magnetic portion with the polarity reversing through the thickness of the band, the bands being arranged such that with the first magnetic portion in the closed position, the band of the first magnetic portion is attracted to the band of the second magnetic portion thereby holding the first and second clasp portions together.

6. The money clip as claimed in claim 5 wherein the arrangement of magnetic material is such that in the open position of the first magnetic portion, there is a net force of repulsion tending to repel the first and second clasp portions apart.

7. The money clip as claimed in claim 6 wherein the second magnetic portion has a plurality of bands of magnetic material extending across the width of the second magnetic portion with the polarity reversing through the thickness of the bands, the bands on the second portion being arranged such that with the first magnetic portion in the closed position, the band of the first magnetic portion is attracted to one of the bands of the second magnetic portion thereby holding the first and second portions together and such that in the open position, the band of the first magnetic portion is disposed adjacent to another band of the second magnetic portion whereby the polarity is such that these two bands repel each other to repel the two clasp portions apart.

8. The money clip as claimed in claim 5 wherein the second magnetic portion has a plurality of bands of magnetic material extending across the width of the second magnetic portion with the polarity reversing through the thickness of the bands, the bands on the second portion being arranged such that with the first magnetic portion in the closed position, the band of the first magnetic portion is attracted to one of the bands of the second magnetic portion thereby holding the first and second portions together and such that in the open position, the band of the first magnetic portion is disposed adjacent to another band of the second magnetic portion whereby the polarity is such that these two bands repel each other to repel the two clasp portions apart.

9. The money clip as claimed in claim 8 wherein the first magnetic portion has a series of bands of alternating polarity through the thickness of the bands and the second magnetic portion has a series of bands with alternating polarity through the thickness of the bands such that in the closed position of to first magnetic portion, the adjacent bands attract and in the open position, the adjacent bands repel each other.

10. The money clip as claimed in claim 9 wherein, the bands associated with each magnetic portion are spaced from each other.

11. The money clip as claimed in claim 2 wherein the magnetic material comprises rare earth magnets.

* * * * *